United States Patent [19]

Sudo et al.

[11] 4,362,463

[45] Dec. 7, 1982

[54] MOVABLE BLADE PUMP

[75] Inventors: Sumio Sudo, Oaza Shimoinayoshi; Hiromichi Anan, Iwamamachi; Masayuki Yamada, Oaza Shimoinayoshi, all of Japan

[73] Assignee: Hitachi, Ltd., Tokyo, Japan

[21] Appl. No.: 231,342

[22] Filed: Feb. 4, 1981

[30] Foreign Application Priority Data

Feb. 6, 1980 [JP] Japan ..... 55/12505
Jun. 18, 1980 [JP] Japan ..... 55/81440

[51] Int. Cl.[3] ..... F01D 7/00; F01D 11/00

[52] U.S. Cl. ..... 415/129; 415/112; 415/175; 416/162

[58] Field of Search ..... 415/129, 112, 142, 175; 416/162, 146 A

[56] References Cited

U.S. PATENT DOCUMENTS 1,950,776 3/1934 Biggs ..... 415/129
1,962,382 6/1934 Biggs ..... 415/129
3,302,951 2/1967 Olesen ..... 415/175
3,474,734 10/1969 Stogner ..... 415/175

FOREIGN PATENT DOCUMENTS 46-4221 2/1971 Japan .

*Primary Examiner*—Peter Feldman
*Attorney, Agent, or Firm*—Antonelli, Terry & Wands

[57] ABSTRACT

A movable blade pump including an actuating mechanism for imparting rotational movement to blades which mechanism is contained in an impeller boss sealed against the outside and filled with hydraulic fluid and is driven by a hydraulic cylinder device secured to a suction casing below the impeller boss. Feed and discharge of hydraulic fluid into and from the hydraulic piston device are effected through fluid passages formed in the suction casing and a fixed mounting for the hydraulic fluid device, and the blades are set at any angular positions within the range of the stroke of the piston.

5 Claims, 2 Drawing Figures

MOVABLE BLADE PUMP

BACKGROUND OF THE INVENTION

This invention relates to a movable blade pump comprising an actuating mechanism disposed in a suction casing below an impeller for varying angular positions of blades.

In movable blade diagonal flow pumps of the prior art, hydraulic fluid is filled in impeller boss which is closed to the outside and contains therein a crosshead and a connecting shaft for converting a reciprocatory movement of an actuating shaft to a rotational movement of the blades. The actuating shaft extends through a main hollow shaft and is connected to a piston in an upper hydraulic cylinder. A motor shaft disposed above the hydraulic cylinder is also hollow, and working fluid passages extend through the motor shaft to be connected to the upper and the lower ends of the hydraulic cylinder. There are provided means for supplying working fluid to these passages from a control located above the motor, and means for effecting feedback control of the position of the hydraulic piston. With this arrangement, the mechanism for transmitting the reciprocatory movement of the actuating shaft to the blades is built in an impeller boss which is filled with hydraulic fluid, so that the hydraulic fluid protects the inside of the impeller boss from invasion of water and other foreign matter outside which may occur corrosion and abrasion, and it provides a good lubricating characteristics. However, some disadvantages are encountered with this arrangement. More specifically, the need to use an elongated actuating shaft and a hollow main shaft and a hollow motor shaft makes fabrication and assembly difficult, thereby increasing cost. Also, the provision of a control on the top of the motor increases the height of the pump above the ground level, so that the pump tends to vibrate. Therefore, there have been a possibility that the hydraulic fluid in the impeller boss leaks and finds its way into the fluid handled by the pump or the fluid handled by the pump enters in the hydraulic fluid.

SUMMARY OF THE INVENTION

It is an object of the invention to provide a movable blade pump which is simple in construction and easy to assemble, and comprises an actuating mechanism mounted in a suction casing below an impeller for varying the angular positions of blades.

According to the invention, there is provided a movable blade pump comprising a hydraulic cylinder chamber secured to a suction casing for mounting a hydraulic cylinder, a piston mounted in the hydraulic cylinder, a non-rotating actuating shaft secured at one end portion thereof to the piston and formed at the other end portion thereof with a connection, a rotary actuating shaft supported by the connection of the non-rotating actuating shaft and connected to an impeller boss mounted on a main shaft for rotation therewith, blades rotatably supported on the impeller boss, and a control mechanism for converting the up and down movement of the rotary actuating shaft into the rotational movement of the blades.

Additional and other objects, features and advantages of the invention will become apparent from the description set forth hereinafter when considered in conjunction with the accompanying drawings.

DESCRIPTION OF THE PREFERRED EMBODIMENT

Figure 1:
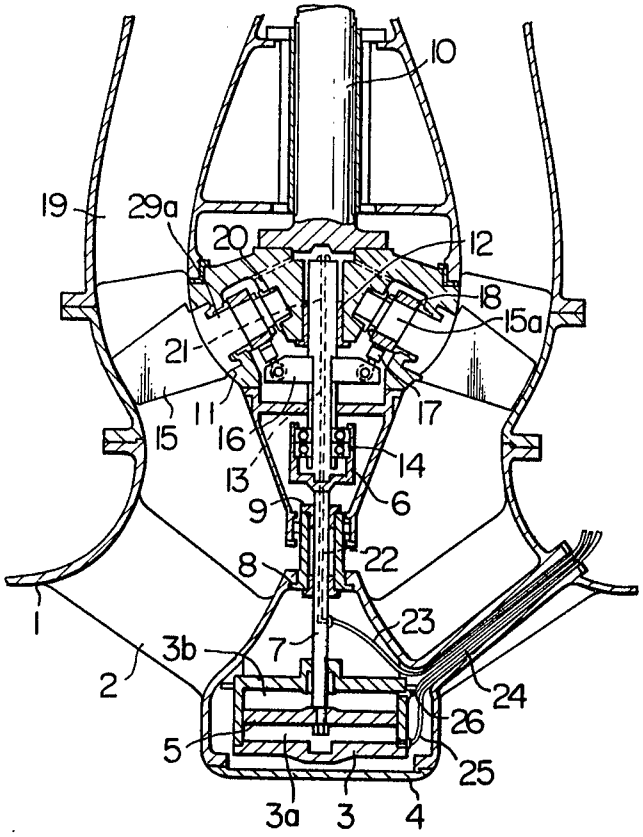
FIG. 1 is a sectional view, on an enlarged scale, of a movable blade section of a movable blade pump according to the invention.

A preferred embodiment of the invention will now be described by referring to the drawings. In FIG. 1, a suction casing 1 mounts therein a hydraulic cylinder chamber 4 having a hydraulic cylinder 3 and secured to the casing through a plurality of guide plates 2. The hydraulic cylinder 3 contains therein a piston 5 having connected thereto one end portion or lower end portion of a non-rotating actuating shaft 7 which is formed with a connection 6 at the other end portion or higher end portion thereof. The non-stationary actuating shaft 7 is journalled by bearings 8 and 9, and the connection 6 of the non-stationary actuating shaft 7 supports through a thrust bearing 14 a rotary actuating shaft 13 which is slidably supported through a bearing 12 by an impeller boss 11 mounted on a main shaft 10. The impeller boss 11 supports a plurality of blades 15 for rotational movement, and bosses 15*a* of the blades 15 are connected to the rotary actuating shaft 13 through a crosshead 16 secured to the rotary actuating shaft 13, connecting shafts 17 and levers 18. The reference numeral 19 designates guide vanes for conducting axially the handled fluid delivered by the blades 15. The impeller boss 11 is formed with a plurality of through holes 20 extending toward the uppermost end of the impeller boss 11 and a portion thereof above the upper end of the rotary actuating shaft 13, and a bore 22 is formed centrally of the stationary actuating shaft 7 to communicate with a bore 21 formed centrally of the rotary actuating shaft 13. The bore 22 is connected to a flexible tube 23 extending through a hole 24 formed in one of the guide plates 2, so that the bore 21 is communicated with the outside. The through holes 20, bores 21 and 22, flexible tube 23 and hole 24 constitute a passage through which the residual air in the impeller boss 11 can be vented to the outside.

Pressure oil pipes 25 and 26 for feeding a fluid under pressure to a lower chamber 3*a* and an upper chamber 3*b* of the hydraulic cylinder 3 respectively also extend through the hole 24 to be connected to a hydraulic control device (not shown) provided at the ground level. FIG. 1 shows various components in balanced positions. With the pump in this condition, feed of the fluid under pressure to the lower chamber 3*a* of the hydraulic cylinder 3 through the pressure oil pipe 25 pushes the piston upwardly to thereby return the fluid under pressure in the upper chamber 3*b* of the hydraulic cylinder 3 to the hydraulic control device (not shown) via the pressure oil pipe 26. The upward movement of the piston 3 moves the non-rotating actuating shaft 7 upwardly to be transmitted to the rotary actuating shaft 13 through the thrust bearing 14. This causes the crosshead 16 secured to the actuating shaft 13 to move correspondingly, to thereby vary the setting of angular positions of the blades 15 through the connecting shafts 17 and the levers 18. Conversely, feed of the fluid under pressure to the upper chamber 3*b* of the hydraulic cylinder 3 through the pressure oil pipe 26 reverses the movements described hereinabove.

Thus by feeding a suitable amount of fluid under pressure either to the pressure oil pipes 25 or 26 by the hydraulic control device, the angular positions of the blades 15 can be adjusted as desired within the range of the stroke of the piston 5.

Upon starting the pump, the residual air collected in the lower end portion of the impeller boss 11 is conducted through the through holes 20 to an air sump at the upper end of the rotary actuating shaft 13. The air thus collected in the air sump can be vented through the holes 21 and 22 to the outside from the pump by connecting the flexible tube 23 to a suction device, such as a vacuum pump, located externally of the pump. To monitor the angles of the blades 15, means for sensing the vertical movement of the non-rotating actuating shaft 7, such as a potentiometer, may be mounted on the hydraulic cylinder 3 to permit an output signal to be utilized for indicating of the angles of the blades and feedback control of the blade angles. By detecting the axial displacement of the actuating shaft, it is possible to automatically control the operation of the pump and to watch the operating conditions of the pump in accordance with the output demand for the pump.

Figure 2:
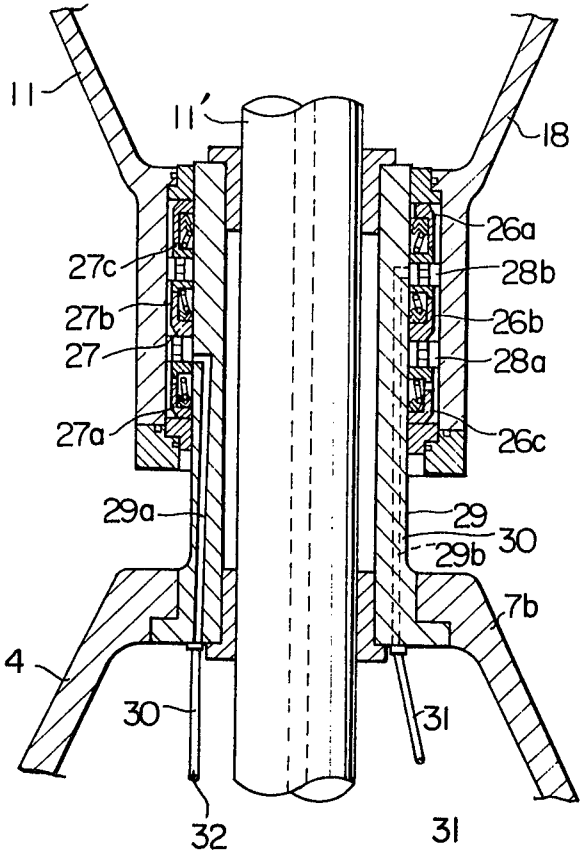
FIG. 2 is a sectional view of a sliding seal section of the pump shown in FIG. 1.

FIG. 2 is a sectional view, on an enlarged scale, of the sliding seal section through which the impeller boss 11 is connected to the hydraulic cylinder chamber 4 shown in FIG. 1. The respective interiors of the impeller boss 11 and hydraulic cylinder chamber 4 are filled with hydraulic fluid, and a plurality of seal members 27, such as mechanical seals, are arranged in the connection therebetween to seal the same against water existing outside. At least three seal members 27 are preferably provided such that in the embodiment shown seal members 27*a*, 27*b* and 27*c* are arranged with the seal members 27*a* and 27*b* defining a seal chamber 28*a* and the seal members 27*b* and 27*c* defining a seal chamber 28*b*. The seal chamber 28*a* is connected, via said seal chamber 28*b*, to a fluid feed pipe 30 via a fluid feeding duct 29*a* formed in a sleeve 29 and to a fluid discharge pipe 31 via a fluid discharging duct 29*b* formed in the sleeve 29. The fluid feed and discharge pipes 30 and 31 as well as the pressure oil pipes 25 and 26 lead to the ground level outwardly of the suction casing 1. The pressure of fluid fed into the seal chamber 28*a* is set higher than that of the fluid handled by the pump flowing around the outer periphery of the impeller boss 11, so that even if the fluid within the impeller boss 11 might leak therefrom into the seal chamber 28*b* through the seal member 27*c*, it would flow through the fluid discharge pipe 31 and be recovered at the ground level. Thus the fluid within the seal chamber 28*b* is prevented from being mixed with the fluid under pressure in the impeller boss 11. By monitoring the amount of fluid leakage through the fluid discharge pipe 31, it is possible to sense the extent to which the mechanical seal members have been deteriorated. Thus the provision of means, such as a flow relay, in the fluid discharge pipe 31, for detecting the amount of fluid leakage can avoid damage to the pump due to failures of the seal members.

The embodiment of the invention shown and described hereinabove can achieve the following effects.

(1) As the actuating mechanism for the movable blades is contained in the impeller boss filled with fluid, any formation of rust and adhesion of foreign matters on the component parts of the actuating mechanism can be avoided. The sliding portions of the mechanism are well lubricated by the fluid, so that wear thereof is lessened and the blades can be moved with a force of a small magnitude.

(2) As the actuating mechanism for the movable blades is contained in and below the impeller boss, ordinary solid shafts can be used as the main shaft of the pump and the shaft of the motor. In addition, fabrication, assembling and disassembling of the pump and motor can be facilitated with a reduction in expenses for installing them.

(3) As the hydraulic cylinder is secured mounted in a position in a lower portion of the suction casing by a plurality of guide plates to dispense with any rotation of the hydraulic cylinder, sealing of the fluid passages through which a fluid under pressure is fed into and out of the hydraulic cylinder can be facilitated to readily deal with fluid leakage.

(4) The use of a plurality of guide plates for the securing of the hydraulic cylinder permits any vortex or turbulent flow of the fluid introduced into the suction casing to flow to the blades in a uniform flow.

(5) Seal members, such as mechanical seals, are arranged between the impeller boss and the hydraulic fluid chamber to define a fluid feed seal chamber and a fluid discharge seal chamber, thereby providing smooth flow of the sealing fluid, there is little possibility of the fluid handled by the pump being mixed with the fluid under pressure in the impeller boss to eliminate any formation of rust in the component parts of the mechanism contained in the impeller boss.

What is claimed is:

1. A movable blade pump comprising:

a hydraulic cylinder chamber secured to a suction casing for mounting a hydraulic cylinder;

a piston mounted in said hydraulic cylinder;

a non-rotating actuating shaft secured at one end portion thereof to the piston and formed at the other end portion thereof with a connection;

a solid rotary actuating shaft supported by the connection of the non-rotating actuating shaft and connected to an impeller boss mounted on a main shaft for rotation therewith;

blades rotatably supported by the impeller boss; and a control mechanism for converting the up and down movement of the rotary actuating shaft into the rotational movement of the blades.

2. A movable blade pump as set forth in claim 1 wherein said impeller boss is sealed against external fluid and filled with hydraulic fluid to prevent entering of the external fluid thereinto.

3. A movable blade pump as set forth in claim 1 wherein the residual air accumulated at an inner upper surface of said impeller boss is vented outside through holes formed in the impeller boss and extending toward the upper end of said rotary actuating shaft, a bore formed axially in said rotary actuating shaft, a bore formed axially in said non-rotating actuating shaft and extending from the connection of the non-rotating actuating shaft to the hydraulic cylinder chamber, and a hole formed in guide plates and extending from the hydraulic cylinder chamber.

4. A movable blade pump as set forth in claim 1, further comprising at least three seal members arranged in three stages in a sliding section between the impeller boss rotating with the main shaft and the hydraulic cylinder chamber secured to the suction casing for mounting the hydraulic cylinder, the seal member disposed adjacent the impeller boss and the intermediate seal member defining therebetween one seal chamber and said another seal chamber being connected to the seal member disposed adjacent the hydraulic cylinder chamber and the intermediate seal member defining therebetween another seal chamber, said one seal chamber being connected to a fluid feed pipe and to a fluid discharge pipe to form a flow system for a sealing fluid.

5. A movable blade pump as set forth in claim 4 wherein the sealing fluid fed into said sealing chamber has a pressure set at a higher level than the pressure of an external fluid.

* * * * *